US012102177B2

(12) United States Patent
Kajiwara

(10) Patent No.: US 12,102,177 B2
(45) Date of Patent: Oct. 1, 2024

(54) SHOE

(71) Applicant: MIZUNO CORPORATION, Osaka (JP)

(72) Inventor: Yo Kajiwara, Osaka (JP)

(73) Assignee: MIZUNO CORPORATION, Osaka (JP)

( * ) Notice: Subject to any disclaimer, the term of this patent is extended or adjusted under 35 U.S.C. 154(b) by 84 days.

(21) Appl. No.: 17/495,425

(22) Filed: Oct. 6, 2021

(65) Prior Publication Data

US 2022/0142298 A1 May 12, 2022

(30) Foreign Application Priority Data

Nov. 11, 2020 (JP) ..... 2020-188259

(51) Int. Cl.

| | |
|---|---|
| ***A43B 23/02*** | (2006.01) |
| ***A43B 23/26*** | (2006.01) |
| ***A43C 1/04*** | (2006.01) |
| ***A43C 11/22*** | (2006.01) |

(52) U.S. Cl.

CPC ..... *A43B 23/0235* (2013.01); *A43B 23/0245* (2013.01); *A43B 23/26* (2013.01); *A43C 1/04* (2013.01); *A43C 11/22* (2013.01)

(58) Field of Classification Search

CPC ..... A43B 1/023; A43B 1/025; A43B 1/028; A43B 1/04

See application file for complete search history.

(56) References Cited

U.S. PATENT DOCUMENTS

| | | | | |
|---|---|---|---|---|
| 4,958,418 | A | 9/1990 | Dufour | |
| 7,823,298 | B2 * | 11/2010 | Nishiwaki | A43B 5/10 36/97 |
| 8,973,410 | B1 * | 3/2015 | Podhajny | D04B 21/207 36/47 |
| 9,907,349 | B2 * | 3/2018 | Huffman | A43B 1/04 |

(Continued)

FOREIGN PATENT DOCUMENTS

| | | | |
|---|---|---|---|
| CN | 210672257 U | * | 6/2020 |
| JP | 60-128509 U | | 8/1985 |

(Continued)

OTHER PUBLICATIONS

Lin Tianfu, Jun. 5, 2020, English Machine Translation CN210672257U_Lin_English provided by Patent Translate by EPO and Google (Year: 2020).*

(Continued)

*Primary Examiner* — Alissa L Hoey
*Assistant Examiner* — Akwokwo Olabisi Redhead
(74) *Attorney, Agent, or Firm* — HSML P.C.

(57) ABSTRACT

A shoe includes a sole and an upper attached to the sole, in which the upper includes an upper main body that covers the forefoot portion, a portion of the midfoot portion, and the heel portion of the wearer, and a tongue that covers a portion of the midfoot portion, the tongue is connected to the upper main body in a front end portion or in the front end portion and portions of side portions, and the front end portion of the tongue is located such that the path length from a rear end portion of the shoe is a range of 35% or more and 50% or less based on a center line passing from the rear end portion to a front end portion of the shoe.

7 Claims, 6 Drawing Sheets

(56) References Cited

U.S. PATENT DOCUMENTS

| | | | | |
|---|---|---|---|---|
| 2006/0162190 | A1* | 7/2006 | Nishiwaki | A43B 5/10 36/97 |
| 2011/0041362 | A1* | 2/2011 | Nishiwaki | A43B 23/047 36/114 |
| 2015/0342284 | A1* | 12/2015 | Huffman | A43B 1/04 66/170 |
| 2017/0142931 | A1* | 5/2017 | Michaelson | A01K 13/002 |
| 2017/0156443 | A1 | 6/2017 | Guyan et al. | |
| 2018/0125166 | A1 | 5/2018 | Kilgore | |
| 2020/0022450 | A1 | 1/2020 | Baines et al. | |

FOREIGN PATENT DOCUMENTS

| | | | | |
|---|---|---|---|---|
| JP | 02-041101 | | 2/1990 | |
| JP | 2008-029716 | | 2/2008 | |
| JP | 2009-034334 | | 2/2009 | |
| WO | WO-2014182651 | A1 * | 11/2014 | A43B 1/00 |

OTHER PUBLICATIONS

Office Action issued in corresponding Japanese Patent Application No. 2020-188259, Jun. 30, 2022, 10 pages w/ translation.

* cited by examiner

SHOE

BACKGROUND OF THE INVENTION

1. Field of the Invention

The present invention relates to a shoe, and specifically to a shoe that has good fittability to a foot and good contact with the foot, and is easy to put on.

2. Description of Related Art

With a shoe upper, usually, eyelet portions and a tongue are separated from each other, and the upper covers an instep portion in a state in which the material of the eyelet portions and the material of the tongue overlap each other. The specification in US 2017/0156443A discloses that, with a shoe in which the upper is composed of a material having a base layer and an auxetic layer, the upper includes a tongue that covers the entire midfoot portion, and eyelet portions that are separated from the tongue. On the other hand, in recent years, in order to improve the contact with the foot, an upper that covers the instep side as a single body has been proposed. The specification in US 2018/0125166A proposes footwear in which an upper is constituted by a sock-shaped upper base member provided with a support member. The specification in US 2020/0022450A proposes footwear provided with an inner component in which a tongue that covers the entire midfoot portion is formed as a single body with an upper main body.

SUMMARY OF THE INVENTION

However, in the case of the shoe disclosed in Patent Document 1, the shoe has poor fittability to a foot because the tongue that covers the entire midfoot portion is separated from the other portion of the upper that includes the eyelet portions, and has poor contact with the foot because the tongue covers the foot in a state in which the material of the tongue and the material of the eyelet portions overlap each other. In the cases of the shoes disclosed in Patent Documents 2 and 3, because the instep side is covered by a single body, there is a problem that, although the shoes have good fittability to the foot and good contact with the foot, the wearing opening is narrow, and these shoes are difficult to put on.

In order to resolve the above-described issues, the present invention provides a shoe that has good fittability to a foot and good contact with the foot, and is easy to put on.

In one or more embodiments, the present invention relates to a shoe that includes a sole and an upper attached to the sole, in which the upper includes an upper main body that covers a forefoot portion, a portion of a midfoot portion, and a heel portion of a wearer, and a tongue that covers a portion of the midfoot portion, the tongue is connected to the upper main body in a front end portion or in the front end portion and a portion of a side portion, and the front end portion of the tongue is located such that a path length from a rear end portion of the shoe is a range of 35% or more and 50% or less based on a center line passing from the rear end portion to a front end portion of the shoe.

In one or more embodiments of the present invention, it is possible to provide a shoe that has good fittability to a foot and good contact with the foot, and is easy to put on.

DETAILED DESCRIPTION OF THE INVENTION

Figure 1:
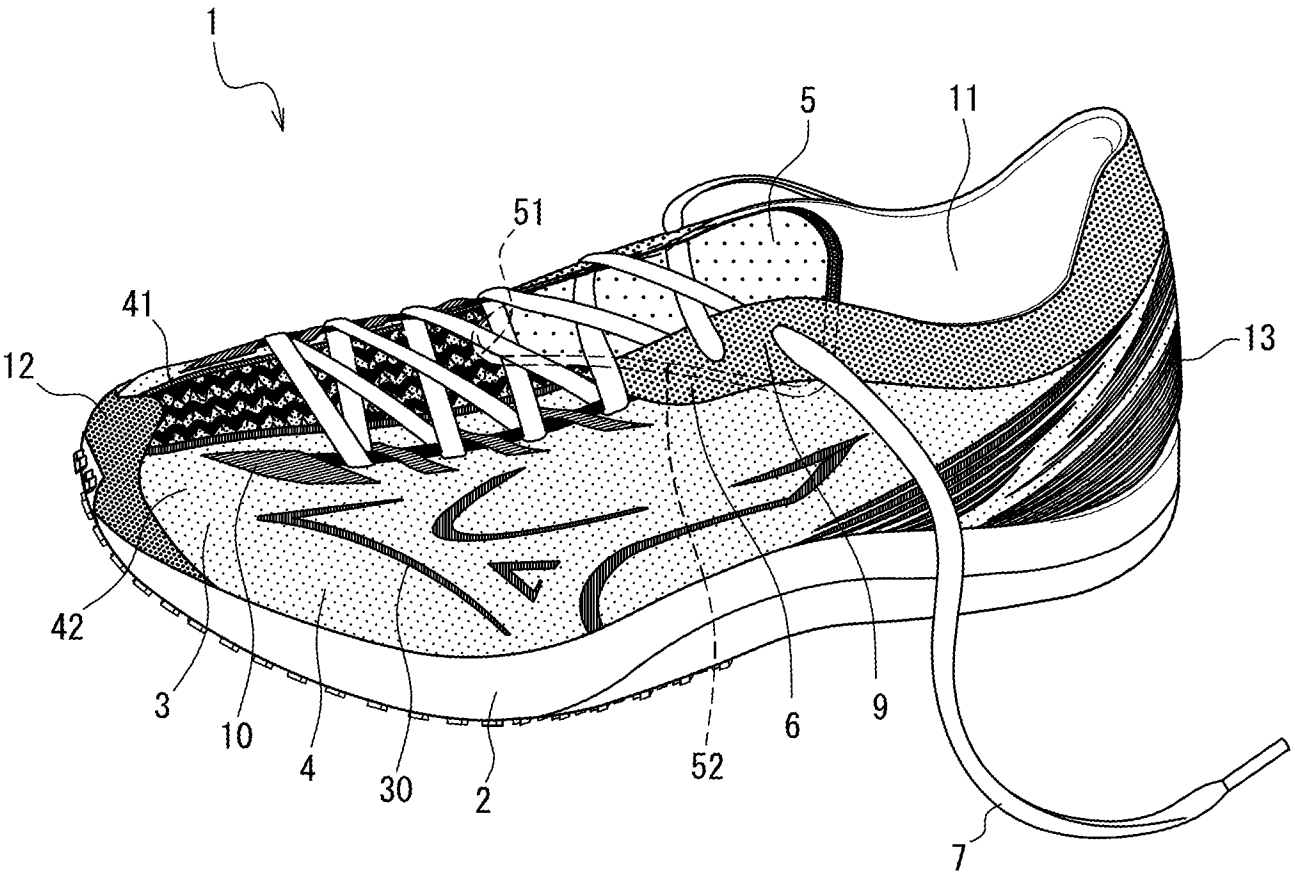
FIG. 1 is a schematic perspective view of a shoe (a left shoe) of one embodiment of the present invention.

The inventor of the present application conducted studies of shoes to reduce the difficulty in putting on a shoe while maintaining the good fittability to a foot and the good contact with the foot that are provided by an upper structure that integrally covers the instep side. As a result, the inventor found that the midfoot portion has a large effect on the fittability to the foot and contact with the foot, and by giving an upper a structure in which the upper includes the upper main body that covers a forefoot portion, a portion of a midfoot portion, and a heel portion of a wearer, and a tongue that covers a portion of the midfoot portion, and by connecting a front end portion of the tongue and the upper main body to each other in a range where the path length from the rear end portion of the shoe is a range of 35% to 50% based on a center line (also referred to as a "last center line" hereinafter) passing from a rear end portion to a front end portion of the shoe, it is possible to provide a shoe that has good fittability to a foot and good contact with the foot, and is easy to put on.

In the present specification, it is presumed that upward (an upper side/upper) and downward (a lower side/lower) represent the positional relationship of the shoe in the up-down direction, frontward (a front side/front) and rearward (a rear side/rear) represent the positional relationship of the shoe in the front-rear direction, and the width direction indicates the right-left direction of the shoe.

In one or more embodiments of the present invention, the center line passing from the rear end portion to the front end portion of the shoe refers to a straight line that connects the rearmost end and the frontmost end of a foot contact surface (an inner surface of an upper) of the shoe (the upper) to each other. At the rearmost end of the foot contact surface of the upper, usually, the rearmost end of the heel comes into contact with the upper, and at the frontmost end of the foot contact surface of the upper, the frontmost end of the tiptoe comes into contact with the upper.

In one or more embodiments of the present invention, with respect to the path length from the rear end portion of the shoe (the rearmost end of the foot contact surface of the shoe) being the range of 35% to 50% based on the center line (also referred to as a "last center line") passing from the rearmost end to the frontmost end of the foot contact surface of the shoe, when the position of the rearmost end of the foot contact surface of the sole is the origin and the path length to the frontmost end of the tiptoe measured along the foot contact surface of the sole is L, the aforementioned range refers to a region extending between two straight lines, namely a straight line that is perpendicular to the last center line and drawn from a position where the path length from the rearmost end of the foot contact surface of the sole is 0.35 L, and a straight line that is perpendicular to the last center line and drawn from a position where the path length from the rearmost end of the foot contact surface of the sole is 0.5 L.

The range in which the path length from the rear end portion of the shoe is the range of 35% to 50% based on the last center line corresponds to a region extending from the center of a vertical arch of the foot to the highest portion of the instep, and when the front end portion of the tongue, that is, the portion where the tongue and the upper main body are connected to each other is located in this range, it is possible to make it easier to put the shoe on due to the tongue that is separated from the upper main body in a portion or the entirety of the side portion, while also maintaining the fittability to the foot and good contact with the foot due to a so-called bootie structure of the upper main body. In one or more embodiments of the present invention, it is preferable that the front end portion of the tongue is located such that the path length from the rear end portion of the shoe is a range of 40% or more and 50% or less based on the last center line, it is more preferable that the front end portion of the tongue is located such that the path length from the rear end portion of the shoe is a range of 45% or more and 50% or less based on the last center line. The upper main body and the tongue can be connected to each other by a connecting means such as sewing, bonding, or embroidering, for example, but the present invention is not particularly limited to this. If a portion of a side portion of the tongue is connected to the upper main body, the front side of the side portion of the tongue is preferably connected to the upper main body.

In one or more embodiments of the present invention, it is preferable that the upper further includes a pair of fastening portions provided with at least a pair of shoelace holes (also referred to as "eyelets") into which a shoelace is insertable, and the fastening portions are separated from the tongue at least rearward of the front end portion of the tongue. Accordingly, in addition to good fittability to the foot and good contact with the foot, holding properties are also improved.

In one or more embodiments of the present invention, it is preferable that the fastening portions are also present in a range where the path length from the rear end portion of the shoe is a range of 50% to 60% based on the last center line. Accordingly, the holding properties are further improved. In one or more embodiments of the present invention, with respect to the path length from the rear end portion of the shoe being the range of 50% to 60% based on the last center line, when the position of the rearmost end of the foot contact surface of the sole is the origin and the path length to the frontmost end of the tiptoe measured along the foot contact surface of the sole is L, the aforementioned range refers to a region extending between two straight lines, namely the straight line that is perpendicular to the last center line and drawn from a position where the path length from the rearmost end of the foot contact surface of the sole is 0.5 L, and a straight line that is perpendicular to the last center line and drawn from a position where the path length from the rearmost end of the foot contact surface of the sole is 0.6 L.

In one or more embodiments of the present invention, the shoe may further include a shoelace that is to be inserted into the shoelace holes. It is preferable that the shoelace does not pass through a region inward of the upper. There is no unevenness due to the shoelace, and the contact with the foot is further improved.

In one or more embodiments of the present invention, although the present invention is not particularly limited to this, it is preferable that separate portions of the fastening portions that are separated from the tongue are located outward of the tongue, and partially overlap with side portions of the tongue. This alleviates localized pressure from the shoelace, and the contact with the foot is further improved.

In one or more embodiments of the present invention, a fabric constituting the upper main body is preferably composed of a fiber structure from the viewpoint of contact with the foot, but the present invention is not particularly limited to this. Examples of the fiber structure include knitted fabrics and woven fabrics. The upper main body may be constituted by a knitted fabric that has been knitted as a single body, or may be constituted by a woven fabric that has been woven as a single body. Also, the upper main body may have a structure in which a plurality of fabric pieces are integrated with each other. The plurality of fabric pieces may be integrated by joining them together through sewing, bonding, embroidering, or the like, for example. From the viewpoint of contact with the foot, it is preferable that the fabrics do not overlap with each other at the joint portion.

In one or more embodiments of the present invention, a fabric constituting the tongue is preferably composed of a fiber structure from the viewpoint of contact with the foot, but the present invention is not particularly limited to this. Examples of the fiber structure include knitted fabrics and woven fabrics.

In one or more embodiments of the present invention, although the present invention is not particularly limited to this, it is preferable that a portion of the upper that covers at least the second metatarsal bone, the third metatarsal bone, the second cuneiform bone, and the third cuneiform bone of the foot of the wearer is formed of an elastic fabric. This further improves the fittability to the instep portion of the foot, and also improves the contact with the foot.

In one or more embodiments of the present invention, "elastic" means that the elongation percentage in the width direction of a fabric and/or the elongation percentage in the length direction of the fabric is 40% or more. In the present invention, the elongation percentage of a fabric can be measured using a method in conformity with Method A in JIS L 1096 8.14.1.

In one or more embodiments of the present invention, although the present invention is not particularly limited to this, it is preferable that fabrics do not overlap with each other in a portion of the upper that covers at least the second metatarsal bone, the third metatarsal bone, the second cuneiform bone, and the third cuneiform bone of a foot of the wearer. This further improves the fittability to the instep portion of the foot, and also improves the contact with the foot.

In one or more embodiments of the present invention, although the present invention is not particularly limited to this, the upper main body is constituted by a mesh fabric from the viewpoint of weight reduction and air permeability. There is no particular limitation on the mesh fabric, and it is possible to use warp knitted fabrics such as single raschel knitted fabrics, double raschel knitted fabrics, and tricot, and weft knitted fabrics such as plain knitted fabrics and circular knitted fabrics as a mesh fabric.

In one or more embodiments of the present invention, although the present invention is not particularly limited to this, a portion of the upper main body that covers a center portion of an instep of the wearer preferably has higher stretchability in a width direction than in a length direction.

Accordingly, the upper main body is likely to follow the shape of the instep portion, and the fittability to the foot is further improved. In one or more embodiments of the present invention, the "center portion of the instep of the wearer" refers to a portion that extends 20 mm to the left and right from the center line in the width direction of the instep and has a width of 40 mm in total.

In one or more embodiments of the present invention, with regard to the upper main body, from the viewpoint of realizing a structure in which a portion covering the center portion of the instep of the wearer has higher stretchability in the width direction than in the length direction, this portion is preferably constituted by a warp knitted fabric that contains non-elastic yarns and elastic yarns, the warp knitted fabric more preferably contains non-elastic yarns in an amount of 85 to 95 mass % and elastic yarns in an amount of 5 to 15 mass %, and even more preferably contains non-elastic yarns in an amount of 90 to 95 mass % and elastic yarns in an amount of 5 to 10 mass %. The warp knitted fabric is disposed such that the longitudinal direction of the elastic yarns (the longitudinal direction of the yarns) extends in the width direction of the instep cover. The elastic yarns may be used as inserting yarns, or may be used as cover yarns that are wrapped around non-elastic yarns.

In one or more embodiments of the present invention, with regard to the upper main body, from the viewpoint of realizing a structure in which the portion covering the center portion of the instep of the wearer has higher stretchability in the width direction than in the length direction, a portion other than the portion covering the center portion of the instep of the wearer is preferably constituted by non-elastic yarns.

In one or more embodiments of the present invention, although the present invention is not particularly limited to this, the elastic yarn preferably has a breaking elongation of 20% or more, and more preferably has a breaking elongation of 20% or more and 50% or less, for example. In one or more embodiments of the present invention, although the present invention is not particularly limited to this, examples of the elastic yarn include elastic yarns constituted by polyurethane-based elastic fibers (also referred to as spandex fibers), polyether-ester-based elastic fibers, and nylon fibers. An elastic yarn may be constituted by only elastic fibers, or may be a yarn obtained by combining elastic fibers with non-elastic fibers, which will be described later.

In one or more embodiments of the present invention, although the present invention is not particularly limited to this, the non-elastic yarn preferably has a breaking elongation of less than 20%, for example. There is no particular limitation on the non-elastic yarn, and examples thereof include non-elastic yarns constituted by non-elastic fibers such as polyester-based fibers such as polyethylene terephthalate fibers and polytrimethylene terephthalate fibers; polyamide-based fibers; polyolefin-based fibers such as polypropylene fibers; cellulosic fibers such as cuprammonium rayon, rayon, cotton, and bamboo fibers; and animal hair-based fibers such as wool.

In one or more embodiments of the present invention, a portion of the upper main body that covers the center portion of the instep of the wearer has low stretchability in a length direction, and the tensile strength thereof, when extended by 10% in the length direction, is preferably 50 N/mm$^2$ or more, more preferably 55 N/mm$^2$ or more, even more preferably 60 N/mm$^2$ or more, and particularly preferably 65 N/mm$^2$ or more. Accordingly, a lifting effect is obtained, and the dropping of the heel after the forefoot portion or the midfoot portion has come into contact with the ground during running is inhibited, making the foot likely to move forward. In one or more embodiments of the present invention, from the viewpoint of obtaining a lifting effect and good contact with the foot, the tensile strength of the portion of the upper main body that covers the center portion of the instep of the wearer, when extended by 10% in the length direction, may be 80 N/mm$^2$ or less, or may be 70 N/mm$^2$ or less. More specifically, in one or more embodiments of the present invention, the tensile strength of the portion of the upper main body that covers the center portion of the instep of the wearer, when extended by 10% in the length direction, is preferably 50 N/mm$^2$ or more and 80 N/mm$^2$ or less, and more preferably 55 N/mm$^2$ or more and 70 N/mm$^2$ or less.

In one or more embodiments of the present invention, the portion of the upper main body that covers the center portion of the instep of the wearer has good stretchability in the width direction, and from the viewpoint of improving wearability when the shoe is worn for a long period of time, for example, the tensile strength thereof, when extended by 10% in the width direction, is preferably 10 N/mm$^2$ or less, more preferably 5 N/mm$^2$ or less, and even more preferably 1 N/mm$^2$ or less. In one or more embodiments of the present invention, from the viewpoint of obtaining good contact with the foot and good holding properties, the tensile strength of the portion of the upper main body that covers the center portion of the instep of the wearer, when extended by 10% in the width direction, is preferably 0.01 N/mm$^2$ or more, more preferably 0.02 N/mm$^2$ or more, and even more preferably 0.15 N/mm$^2$ or more. More specifically, in one or more embodiments of the present invention, the tensile strength of the portion of the upper main body that covers the center portion of the instep of the wearer, when extended by 10% in the width direction, is preferably 0.02 N/mm$^2$ or more and 10 N/mm$^2$ or less, and more preferably 0.15 N/mm$^2$ or more and 5 N/mm$^2$ or less.

In one or more embodiments of the present invention, the tensile strength of the portion of the upper main body that covers the center portion of the instep of the wearer, when extended by 10%, can be measured in conformity with Method Ain JIS L 1096 8.14.1 under the condition that the tensile speed is 100 mm/min.

In one or more embodiments of the present invention, the upper main body may be constituted by a warp knitted fabric that has been knitted as a single body, the portion covering the center portion of the instep of the wearer may be knitted with non-elastic yarns and elastic yarns, and portions other than the portion covering the center portion of the instep of the wearer may be knitted with non-elastic yarns.

In one or more embodiments of the present invention, the portion of the upper main body that covers the center portion of the instep of the wearer, and the portions other than the portion covering the center portion of the instep of the wearer may be constituted by different fabric pieces, and may be integrated by joining the different fabric pieces together through sewing, bonding, embroidering, or the like. It is preferable that different fabric pieces are joined together through embroidering. This realizes good contact with the foot, and good fittability of a shoe to the instep side of the foot. A reinforcing non-woven fabric is disposed on an embroidered portion, and thus joining strength is increased. There is no particular limitation on the reinforcing non-woven fabric, and a non-woven fabric that is usually used in embroidering may be used. The embroidery may be a satin embroidery or tatami embroidery.

In one or more embodiments of the present invention, although the present invention is not particularly limited to this, from the viewpoint of weight reduction and air permeability, the fabric that constitutes the upper main body preferably has a basis weight (mass per unit area) of 300 g/m$^2$ or more and 550 g/m$^2$ or less, and more preferably has a basis weight of 300 g/m$^2$ or more and 410 g/m$^2$ or less.

In one or more embodiments of the present invention, although the present invention is not particularly limited to this, the tongue is preferably thicker than the upper main body. This alleviates localized pressure from the shoelace, and the contact with the foot with is further improved. In one or more embodiments of the present invention, the fabric that constitutes the tongue preferably has a basis weight of 250 g/m$^2$ or more and 550 g/m$^2$ or less, and more preferably has a basis weight of 250 g/m$^2$ or more and 410 g/m$^2$ or less.

In one or more embodiments of the present invention, the upper main body may have a shape covering the entire plantar side of the foot. In this case, the upper main body has a bag shape. This further increases the unity of the upper and the sole, and thus the fittability to the foot is further improved.

In the shoe in one or more embodiments of the present invention, the upper is attached to the sole. There is also no particular limitation on the attaching method, and examples thereof include a normal cemented construction method. The sole may be selected as appropriate and used according to the application of the shoe and the like.

In one or more embodiments of the present invention, it is preferable to reinforce the tiptoe portion, the heel portion, and the fastening portion of the shoe with use of artificial leather. The shape and holding properties of the shoe can be maintained through reinforcement. Also, the surface of the shoe upper may be decorated as needed.

Hereinafter, an embodiment of the present invention will be described in detail with reference to the drawings. Like reference numerals indicate like portions in the drawings. Note that the present invention is not limited to the embodiments shown in the following drawings. A left shoe is described as an example in the drawings, and a right shoe is not shown in the drawings.

Figure 2:
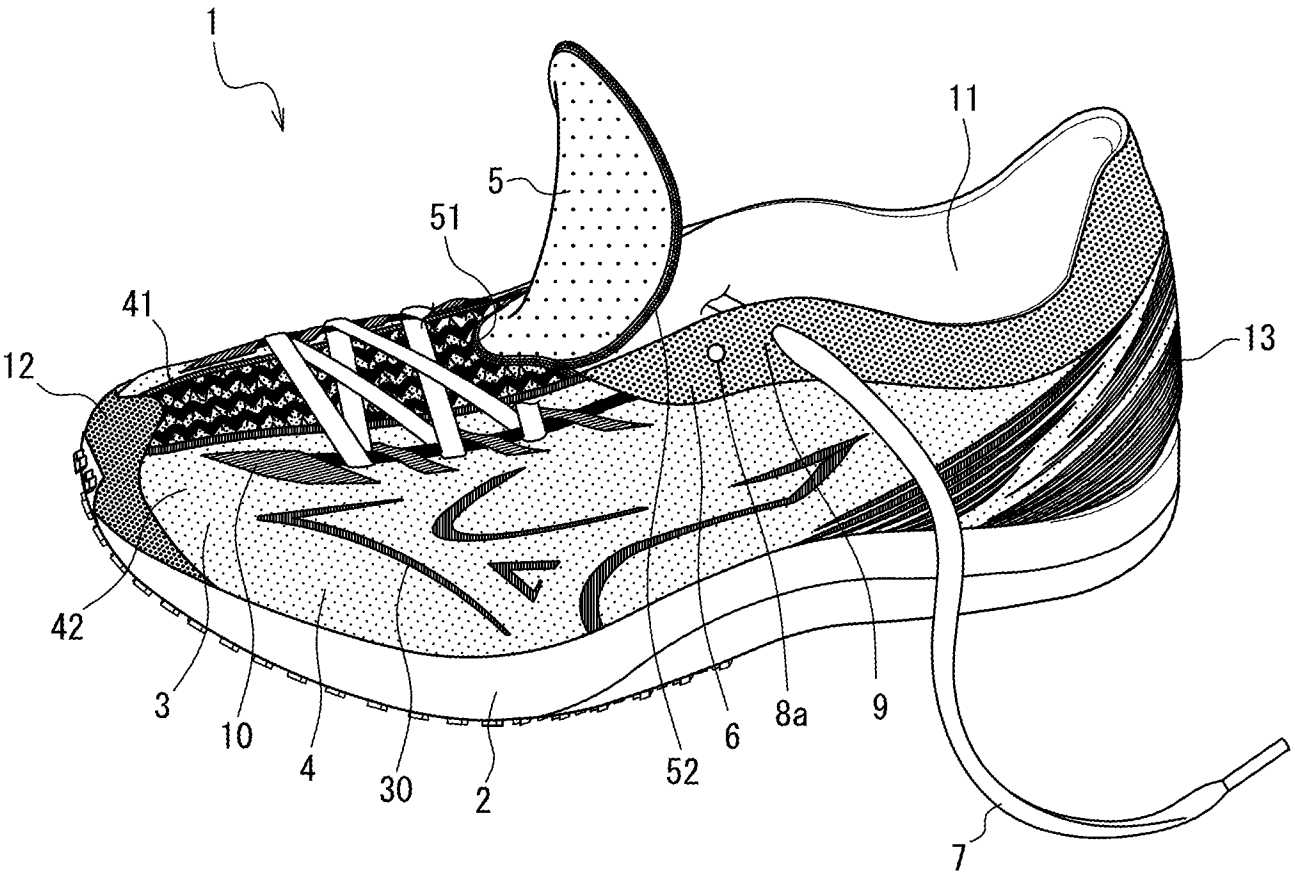
FIG. 2 is a schematic perspective view showing the same shoe with emphasis on a tongue and a separate portion of a fastening portion that is separated from the tongue, and does not show a portion of a shoelace.
Figure 3:
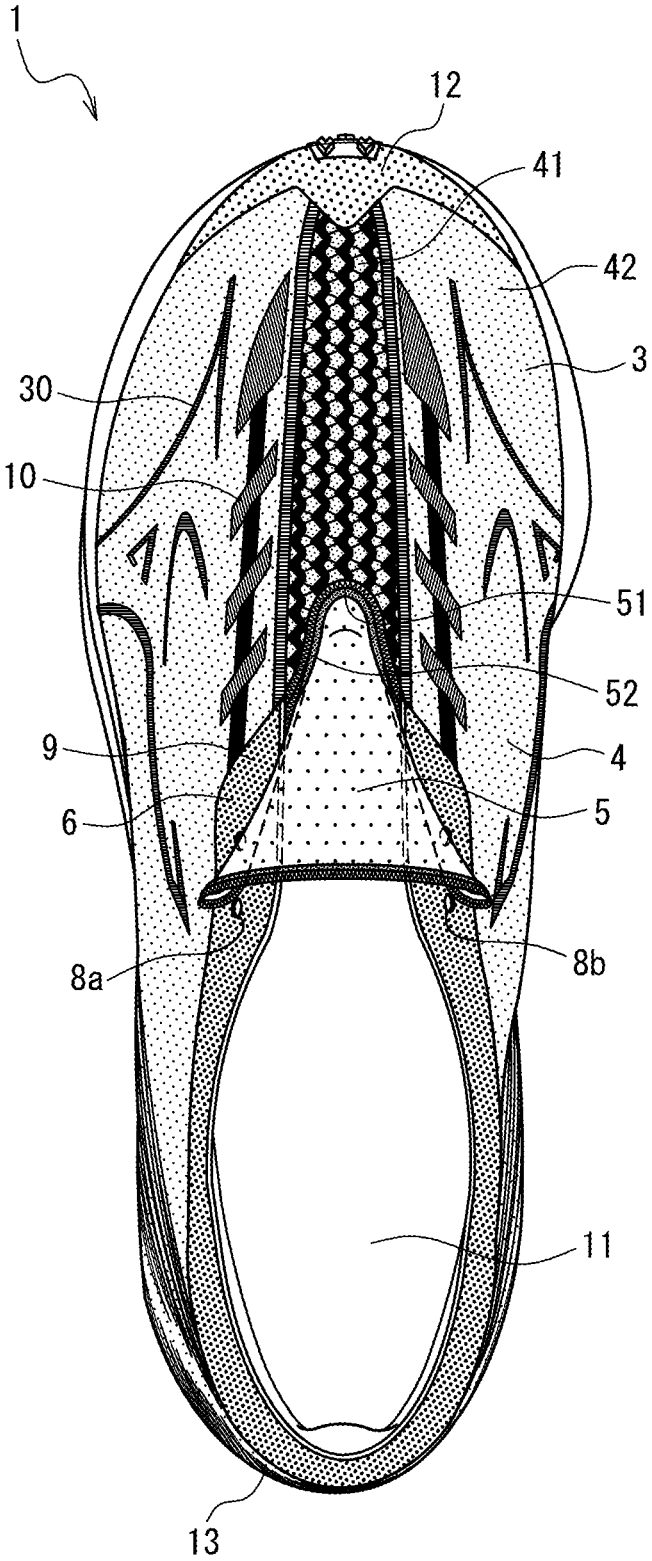
FIG. 3 is a schematic surface view of the same shoe.
Figure 4A:
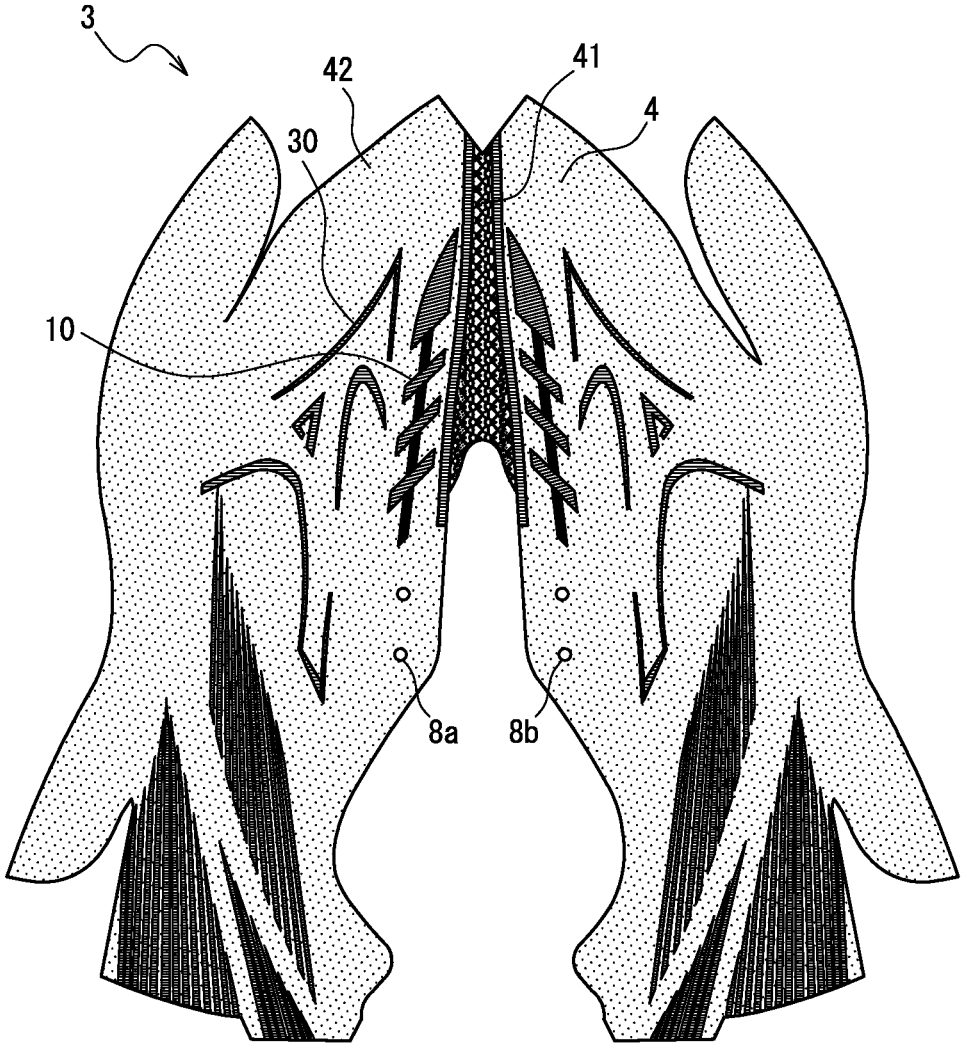
FIGS. 4A and 4B are schematic surface development views of an upper of the same shoe.
Figure 4B:
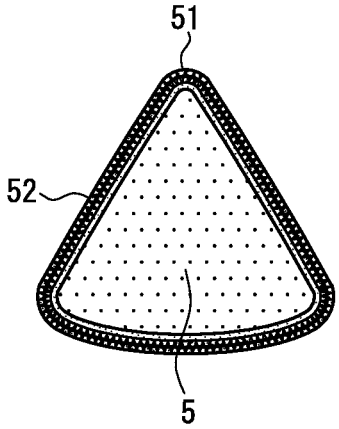
Figure 5:
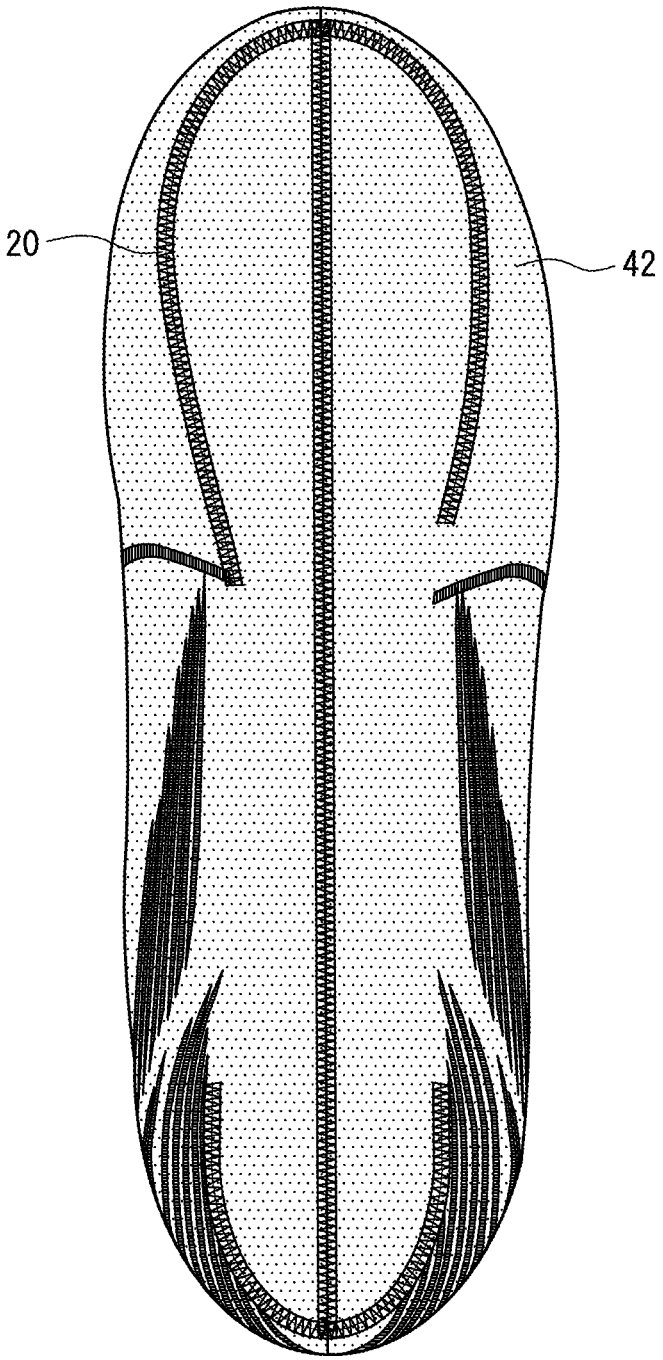
FIG. 5 is a schematic surface view of a sole contact surface of the upper of the same shoe.

FIG. 1 is a schematic perspective view of a shoe (a left shoe) of one embodiment of the present invention. FIG. 2 is a schematic perspective view showing the same shoe with emphasis on a tongue and a separate portion of a fastening portion that is separated from the tongue, and does not show a portion of a shoelace. FIG. 3 is a schematic surface view of the same shoe. FIGS. 4A and 4B are schematic surface development views of an upper of the same shoe. FIG. 5 is a schematic surface view of a sole contact surface of the upper of the same shoe.

In this embodiment, a shoe 1 includes a sole 2 and an upper 3. The upper 3 includes an upper main body 4 that covers the forefoot portion, a portion of the midfoot portion, and the heel portion of the wearer, and a tongue 5 that covers a portion of the midfoot portion.

The tongue 5 is connected to the upper main body 4 in a front end portion 51 through sewing. The tongue 5 may also be connected to the upper main body 4 in a portion of side portions 52 in addition to the front end portion 51. The tongue 5 is preferably connected to the upper main body 4 at a portion in front of the side portions 52.

The front end portion 51 of the tongue 5 is located in a range where the path length from a rear end portion of the shoe is a range of 35% to 50% based on a center line passing from the rear end portion to the front end portion of the shoe.

Figure 6:
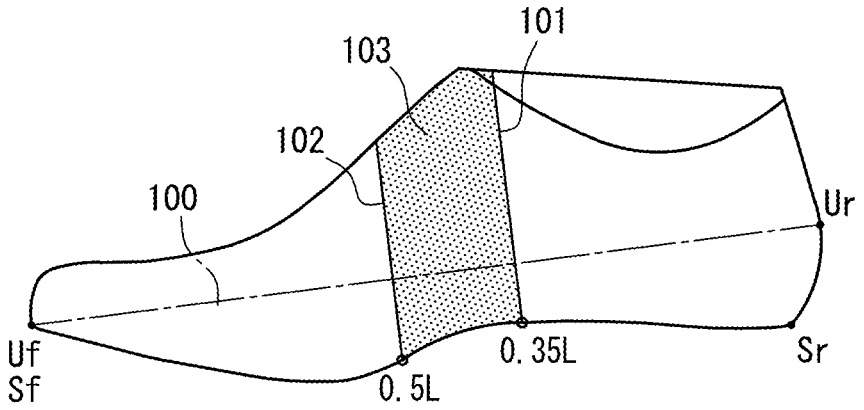
FIG. 6 is a schematic diagram illustrating the path length from a rear end portion of the shoe based on a center line passing from the rearmost end to a frontmost end of a foot contact surface of the shoe.

FIG. 6 is a schematic diagram illustrating the path length from the rear end portion of the shoe (the rearmost end of the foot contact surface of the shoe) based on the center line (last center line) passing from the rearmost end to the frontmost end of the foot contact surface of the shoe. A last is used in order to describe the foot contact surface of the shoe. A last center line 100 is a straight line that connects a rearmost end Ur and a frontmost end Uf on the foot contact surface (the inner side) of the upper. When the position of the rearmost end of the foot contact surface of the sole is an origin Sr, and the path length (which corresponds to the path length along the last bottom surface and is referred to as the "entire path length" hereinafter) to a frontmost end Sf of a tiptoe that has been measured along the foot contact surface of the sole is L, with respect to the position of a straight line that is perpendicular to the last center line and drawn from a position where the path length from the rearmost end Sr of the foot contact surface of the sole is a predetermined percentage of the entire path length, the position of the straight line is a position where the path length from the rear end portion of the shoe based on the last center line is a predetermined percentage of the entire path length. The position where the path length from the rear end portion of the shoe based on the last center line is 35% refers to the position of a straight line 101 that is perpendicular to the last center line and drawn from the position where the path length from the rear end Sr of the foot contact surface of the sole is 0.35 L, for example. The position where the path length from the rear end portion of the shoe based on the last center line is 50% refers to the position of a straight line 102 that is perpendicular to the last center line and drawn from the position where the path length from the rear end Sr of the foot contact surface of the sole is 0.5 L. The range where the path length from the rear end portion of the shoe is a range of 35% to 50% of the last center line refers to a region 103 sandwiched between the straight line 101 and the straight line 102.

In the upper main body 4, a portion 41 covering the center portion of the instep of the wearer and the other portion 42 are constituted by different fabric pieces. These different fabric pieces are joined together through embroidering. The other portion 42 is constituted by a single fabric, and the upper main body 4 is sewn in a bag shape (a sewing line 20) and also covers the entire plantar side of the foot. It is preferable that the portion 41 covering the center portion of the instep of the wearer has higher stretchability in the width direction than in the length direction. It is preferable that the other portion 42 has low stretchability in the length direction and the width direction.

The portion 41 covering the center portion of the instep of the wearer may be constituted by a single raschel knitted fabric that includes elastic fibers (elastic yarns) in an amount of 5 mass % or more and 15 mass % or less and non-elastic fibers (non-elastic yarns) in an amount of 85 mass % or more and 95 mass % or less, is disposed such that the longitudinal direction of the elastic fibers (elastic yarns) extends along the width direction, has a basis weight of 300 g/m$^2$ or more and 550 g/m$^2$ or less, and has a thickness of 1 mm or more and 5 mm or less, for example. Spandex fibers (monofilaments, 140 dtex) may be used as an elastic yarn, for example. A polyester-based non-elastic yarn (multifilaments, the number of filaments is 48, 150 dtex) may be used as a non-elastic yarn, for example.

The other portion 42 may be constituted by a single raschel knitted fabric that is constituted by non-elastic fibers (non-elastic yarns), has a basis weight of 300 g/m$^2$ or more and 550 g/m$^2$ or less, and has a thickness of 1 mm or more and 5 mm or less, for example. A polyester-based non-elastic yarn (multifilaments, the number of filaments is 48, 150 dtex) may be used as non-elastic fibers (non-elastic yarn), for example.

If the upper main body is constituted by the above-described fabric, adjustment can be easily performed such that the tensile strength of the portion 41 covering the center portion of the instep of the wearer, when extended by 10% in the length direction, is in a range of 50 N/mm$^2$ or more and 70 N/mm$^2$ or less. Also, adjustment can be easily performed such that the tensile strength of the portion 41 covering the center portion of the instep of the wearer, when extended by 10% in the width direction, is in a range of 0.01 N/mm$^2$ or more and 10 N/mm$^2$ or less while adjustment is performed such that the tensile strength of the portion 41 covering the center portion of the instep of the wearer, when extended by 10% in the length direction, is in a range of 10 N/mm$^2$ or more and 70 N/mm$^2$ or less.

The upper 3 further includes a fastening portion 6, and the fastening portion 6 is preferably provided with at least a pair of shoelace holes 8*a* and 8*b* into which a shoelace 7 is insertable. The fastening portion 6 may include a rear fastening portion 9 that is separated from the tongue 5 in a portion rearward of the front end portion of the tongue 5. It is preferable that the rear fastening portion 9 is disposed outward (upward) of the tongue 5 and partially overlaps with side portions of the tongue 5. The rear fastening portion 9 may have a reinforcing layer disposed outward (upward) and inward (downward) of the fabric that constitutes the upper main body 4. The outer reinforcing layer may be constituted by artificial leather, for example.

The fastening portion 6 may also be present in the range where the path length from the rearmost end of the shoe is a range of 50% or more and 60% or less base on the last center line. In the fastening portion 6, a front fastening portion 10 may be integrated with the upper main body 4 by performing embroidering to form shoelace holes that have a predetermined size for insertion of a shoelace or the like.

In the upper 3, the degree of extension in the length direction and the width direction may be adjusted by providing an extension control portion 30 as appropriate. From the viewpoint of reinforcement and aesthetic appearance, the extension control portion 30 may be provided through embroidering.

The shoe 1 is provided with a wearing opening 11. The shoe 1 further includes a tiptoe reinforcing portion 12 and a heel reinforcing portion 13. The tiptoe reinforcing portion 12 may be constituted by artificial leather, for example. The heel reinforcing portion 13 may be constituted by embroidering. The heel reinforcing portion 13 may be provided with a lining material.

EXAMPLES

Hereinafter, one or more embodiments of the present invention will be more specifically described with reference to the examples. Note that the present invention is not limited to the following example.

The following fabrics were used in an example and comparative examples.

Fabric a: A single raschel knitted fabric that contained spandex fibers (monofilaments, 140 dtex) in an amount of 5 to 15 mass % and polyester-based non-elastic yarns (multifilaments, the number of filaments was 48, 150 dtex) in an amount of 85 to 95 mass %, that had a basis weight of 402 g/m$^2$ and a thickness of 1.00 mm. The elongation percentage of Fabric a in the length direction was 19.5%, and the elongation percentage thereof in the width direction was 800%. The tensile strength of Fabric a, when extended by 10% in the length direction, was 31 N/mm$^2$, and the tensile strength of Fabric a, when extended by 10% in the width direction, was 0.02 N/mm$^2$.

Fabric b: A single raschel knitted fabric that contained polyester-based non-elastic yarns (multifilaments, the number of filaments was 48, 150 dtex) in an amount of 100 mass %, that had a basis weight of 232 g/m$^2$ and a thickness of 0.64 mm. The elongation percentage of Fabric b in the length direction was 35%, and the elongation percentage thereof in the width direction was 80%. The tensile strength of Fabric b, when extended by 10% in the length direction, was 16 N/mm$^2$, and the tensile strength of Fabric b, when extended by 10% in the width direction, was 0.2 N/mm$^2$.

Fabric c: A double raschel knitted fabric that contained spandex fibers (monofilaments, 140 dtex) in an amount of 15 mass % and polyester-based non-elastic yarns (multifilaments, the number of filaments was 48, 150 dtex) in an amount of 85 mass %, that had a basis weight of 267 g/m$^2$ and a thickness of 1.7 mm. The elongation percentage of Fabric c in the length direction was 800%, and the elongation percentage thereof in the width direction was 900%. The tensile strength of Fabric c, when extended by 10% in the length direction, was 0.02 N/mm$^2$, and the tensile strength of Fabric c, when extended by 10% in the width direction, was 0.01 N/mm$^2$.

Note that the elongation percentages of Fabrics a, b, and c were measured based on Method A in JIS L 1096 8.14.1 under the condition that the tensile speed was 200 mm/min, and the tensile strengths of Fabrics a, b, and c were measured based on Method Ain JIS L 1096 8.14.1 under the condition that the tensile speed was 100 mm/min.

Example 1

A shoe shown in FIG. 1-4 was produced using Fabric a for the portion 41 covering the center portion of the instep of the wearer, using Fabric b for the other portion 42, and using Fabric c for the tongue 5. The upper main body 4 was connected to the tongue 5 through sewing only in the front end portion of the tongue 5, and the front end portion of the tongue 5 was located at a position where the path length from the rear end portion of the shoe was 48% based on the last center line. The rear end portion of the tongue 5 was located at a position where the path length from the rear end portion of the shoe was 35% based on the last center line.

Comparative Example 1

A shoe was produced in the same manner as in Example 1, except that the front end portion of the tongue 5 was located at a position where the path length from the rear end portion of the shoe was 65% based on the last center line.

Comparative Example 2

A shoe was produced in the same manner as in Example 1, except that the front end portion and the two side portions of the tongue 5 were all connected to the upper main body 4 through sewing.

The shoes produced in the example and comparative examples were put on by a subject, and sensory evaluation was performed regarding the fittability to the foot, contact with the foot, and how easy it was to put the shoe on. In the case of Example 1, the shoe had good fittability to the foot and good contact with the foot, and the shoe was easy to put on. On the other hand, in the case of Comparative Example 1, the shoe was easy to put on, but the shoe had poor fittability to the foot and poor contact with the foot. In the case of Comparative Example 2, the shoe had good fittability to the foot and good contact with the foot, but the shoe was difficult to put on.

The above-described embodiments are to be considered in all respects merely as examples of the present invention and not limiting. Persons skilled in the art relating to the present invention may construct various embodiments employing the principles of the present invention, without departing from the spirit and essential characteristics of the present invention when considering the above-described teaching, even if not explicitly stated in this specification.

A shoe of one or more embodiments of the present invention can be suitably used as various shoes including sports shoes such as running shoes.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A shoe comprising:

a sole and an upper attached to the sole, wherein the upper includes an upper main body that covers a forefoot portion, a portion of a midfoot portion, and a heel portion of a wearer, and a tongue that covers a portion of the midfoot portion, the tongue is connected to the upper main body in a front end portion or in the front end portion and a portion of side portions, the front end portion of the tongue is located such that a path length from a rear end portion of the shoe is a range of 35% or more and 50% or less based on a center line passing from the rear end portion to a front end portion of the shoe, the upper further comprises a pair of fastening portions provided with at least a pair of shoelace holes into which a shoelace is insertable, each of the fastening portions includes a front fastening portion and a rear fastening portion that is independent of the front fastening portion, the rear fastening portion is separated from the tongue at least rearward of the front end portion of the tongue, the front fastening portion does not overlap with the tongue, two or more pairs of the shoelace holes are provided for the rear fastening portions of the pair of fastening portions, a first portion of the upper main body and a second portion of the upper main body are constituted by different fabric pieces, the first portion of the upper main body covers a center portion of an instep of the wearer, and the first portion of the upper main body that covers the center portion of the instep of the wearer has higher stretchability in a width direction than in a length direction, and the front fastening portions are located on the second portion of the upper main body such that the first portion of the upper main body that covers the center portion of the instep of the wearer is between the front fastening portions.

2. The shoe according to claim 1, wherein a portion of the upper that in use covers at least a second metatarsal bone, a third metatarsal bone, a second cuneiform bone, and a third cuneiform bone of a foot of the wearer is formed of an elastic fabric.

3. The shoe according to claim 1, wherein the fastening portions are also present in a range where a path length from the rear end portion of the shoe is a range of 50% or more and 60% or less based on the center line passing from the rear end portion to the front end portion of the shoe.

4. The shoe according to claim 1, wherein the tongue is thicker than the upper main body.

5. The shoe according to claim 1, wherein the rear fastening portions are located outward of the tongue and partially overlap with the side portions of the tongue.

6. The shoe according to claim 1, further comprising a shoelace that is to be inserted into the shoelace holes, wherein the shoelace does not pass through a region inward of the upper.

7. The shoe according to claim 1, wherein a tensile strength of the first portion of the upper main body that covers the center portion of the instep of the wearer, when extended by 10% the length direction, is 50 $N/mm^2$ or more.

* * * * *